US005943980A

United States Patent [19]

Huang

[11] Patent Number: 5,943,980

[45] Date of Patent: Aug. 31, 1999

[54] BANNER CONNECTING APPARATUS OF A FLAG POLE

[76] Inventor: Chen-Chao Huang, No. 20, Lane 124, Sec. 5, Hsin Hai Road, Taipei, Taiwan

[21] Appl. No.: 08/915,176

[22] Filed: Aug. 20, 1997

[51] Int. Cl.[6] ..... G09F 17/00

[52] U.S. Cl. ..... 116/174; 403/908.1; 116/173

[58] Field of Search ..... 40/586; 116/173, 116/174; 403/409.1, 109

[56] References Cited

U.S. PATENT DOCUMENTS

| | | | |
|---|---|---|---|
| 1,017,603 | 2/1912 | Soth | 40/617 |
| 3,183,886 | 5/1965 | Moffitt, Jr. | 116/173 |
| 3,515,418 | 6/1970 | Nielsen, Jr. | 403/908.1 |
| 3,596,946 | 8/1971 | Burton | 403/908.1 |
| 3,706,297 | 12/1972 | Voorhees | 116/174 |
| 4,419,026 | 12/1983 | Leto | 403/109 X |
| 5,279,250 | 1/1994 | Palermo, Jr. et al. | 116/174 |
| 5,375,555 | 12/1994 | Dolan | 116/174 |
| 5,487,529 | 1/1996 | Newville | 403/109 |
| 5,522,342 | 6/1996 | Chen-Chao | 116/174 |
| 5,572,835 | 11/1996 | Atkins et al. | 116/173 X |

FOREIGN PATENT DOCUMENTS

| | | | |
|---|---|---|---|
| 2255851 | 11/1992 | United Kingdom | 116/174 |

*Primary Examiner*—Hezron Williams
*Assistant Examiner*—Willie Morris Worth
*Attorney, Agent, or Firm*—Rosenberg, Klein & Bilker

[57] ABSTRACT

A banner connecting apparatus of a flag pole is provided. The apparatus comprises upper and lower coupling buttons, each coupling button including a connecting ring adapted to rotate about the flag pole and a connecting button engaging a coupling hole of a banner. The apparatus also comprises a cylindrical spacing sleeve disposed between the upper and lower coupling buttons and adapted to be received on the flag pole. The apparatus further comprises an elastic retaining mechanism for engaging the flag pole. The elastic retaining mechanism adjustably limits the longitudinal displacement of at least one connecting ring with respect to the flag pole. The banner connecting apparatus connects a banner to a flag pole while preventing the banner from wrapping around that flag pole.

7 Claims, 4 Drawing Sheets

BANNER CONNECTING APPARATUS OF A FLAG POLE

FIELD OF THE INVENTION

The present invention refers to a banner connecting apparatus of a flag pole, more particularly relates to an apparatus enabling the flag banner to fly in accordance with the different blowing direction of wind without wrapping the flag around the pole.

BACKGROUND OF THE INVENTION

As for conventional flag structure, as shown in FIG. 7, which comprises two connecting loops(1)(2) and a clamp (3), Wherein a first connecting loop (1) is connected to an annular recess (6) under the top portion (4) of a flag pole for buttoning up the banner holes (8) of a flag banner (7). A second connecting loop (2) is connected to the annular recess (6) below the clamp (3) fixed on the flag pole (5) moveable by force along the flag pole (5) to adjust the second connecting loop (2) in accordance with the width of the flag banner (7) for buttoning up the lower banner holes (9) of the flag banner (7), enabling connecting loops (1)(2) to rotate with the flying flag banner in different directions and prevent the banner (7) from wrapping around the flag pole (5).

OBJECTS OF THE INVENTION

The main object of the present invention is to provide a coupling button comprising connecting ring and connecting button instead of conventional first and second connecting loops in prior art, looping directly to the flag pole and with a cylinder in length equivalent the width of a flag banner looped on the pole between upper and lower coupling buttons to prevent the banner from wrapping around the flag pole achieving the same effect.

Further, the present invention provides a compressible flag pole comprising two or more than two coupling cylinders.

The third object of the invention is to provide a pole top portion with any design symbolizing a certain association for indication.

SUMMARY OF THE INVENTION

A banner connecting apparatus of a flag pole comprises an upper coupling button consisted by an connecting ring looped to a flag pole and a connecting button for buttoning up upper banner holes, a lower connecting button buttoning up lower banner holes, a cylinder looping the flag pole provided between the upper and lower connecting buttons, and a clamp fixed to the flag pole under the lower connecting button to support the upper connecting button, cylinder and lower connecting button, disposed connectively on a compressible flag pole comprising two or more than two cylinders to prevent the banner from wrapping the flag pole.

DETAILED DESCRIPTION OF THE INVENTION

Figure 1:
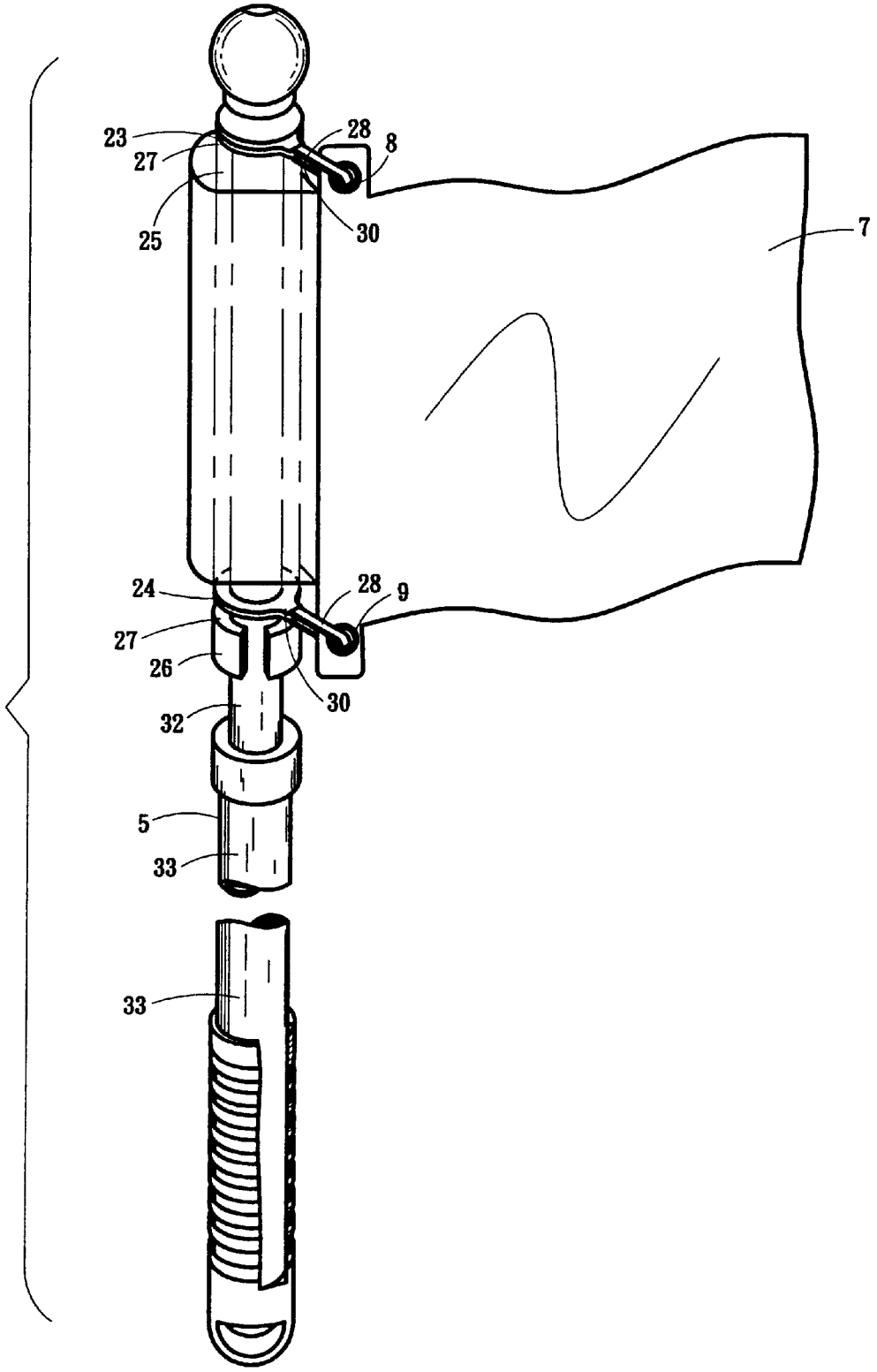
FIG. 1 is a perspective view of this invention in using state.
Figure 2:
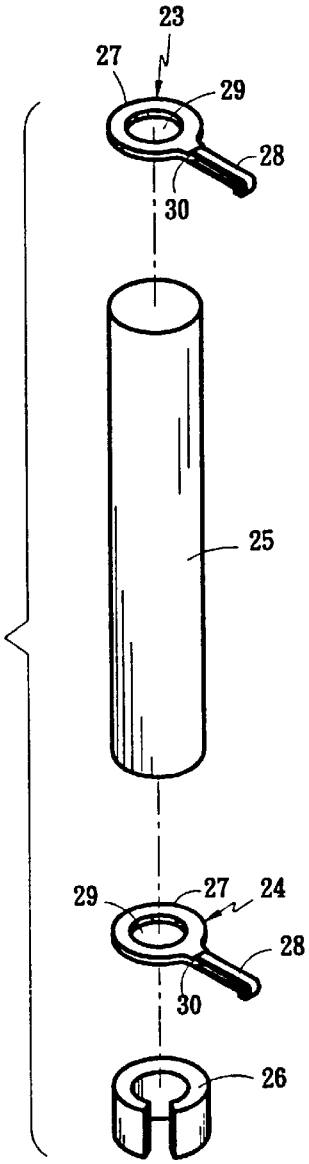
FIG. 2 is a decomposing view of this invention.

As shown in FIG. 1 and FIG. 2, this invention is composed by an upper and lower coupling buttons (23)(24), cylinder (25), and elastic clamp (26). Wherein, both upper and lower coupling buttons (23)(24) are formed by connecting ring (27) and connecting button (28). The connecting ring (27) is a loop with an inner diameter slightly greater than the outer diameter of the flag pole (5) for looping on said flag pole (5), with a projecting connecting hole (30) for engaging a connecting button (28). Said connecting button (28) is an elongated circular button having an elastic open section for buttoning up two banner holes (8)(9) of a banner by stressing force, with elasticity the open section can rebound to close itself. On the flag pole (5) between upper and lower coupling buttons(23)(24) is the cylinder (25) having an inner diameter greater than the outer diameter of the flag pole (5) and an outer diameter greater than the inner diameter of said connecting ring (27) of the coupling buttons (23)(24), and length equivalent to the width of a flag banner (7) to keep said connecting ring (27) of the coupling buttons (23)(24) secured normally to the flag pole (5) to avoid incline affecting its rotation and prevent the coupling buttons (23)(24) from moving centrally by the strength of a blowing flag banner (7) and wrinkling the flag banner (7). Below said lower coupling button (24) is a clamp (26) disposed on the flag pole (5). Said clamp (26) is a circular elastic clamp secured to the flag pole (5) below the lower coupling button (24) adjustable along the flag pole (5) to keep the connecting ring (27) of upper connecting button (23) secured between the flag top (4) and the top end of said cylinder (25) and the connecting ring (27) of lower connecting button (24) between lower end of said cylinder (25) and the top of the clamp (26) enabling the flag banner (7) to fly freely with the direction changes of wind and prevent the banner (7) from wrapping around the flag pole (5).

Figure 3:
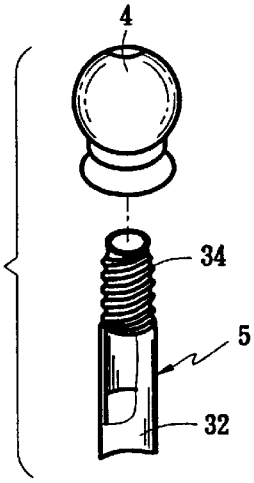
FIG. 3 is a decomposing view of the flag top of the invention.
Figure 5:
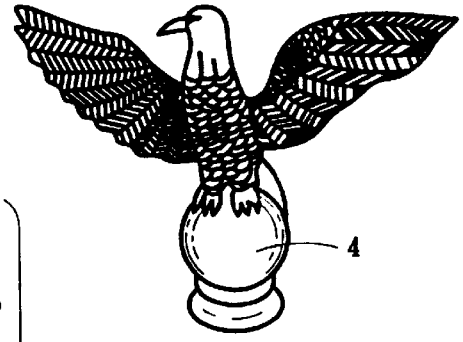
FIG. 5 is a perspective view of a flag top of a preferred embodiment of this invention.
Figure 4:
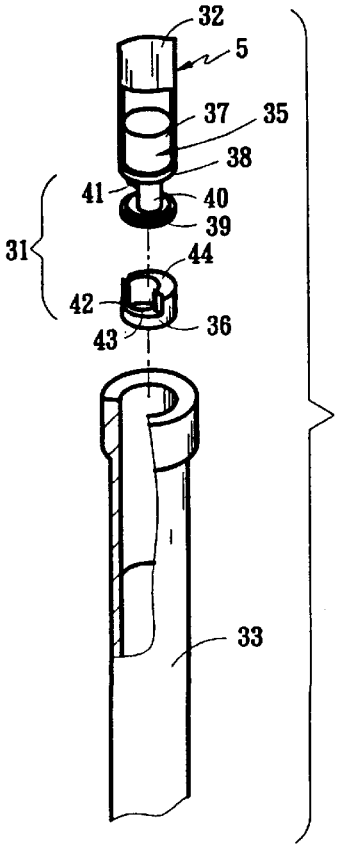
FIG. 4 is a decomposing view showing the bias structure within the flag pole.

As referring to FIGS. 1, 3 and 4 showing the flag pole of this invention is possibly an integral pole (not shown) or a compressible pole composed of two or more than two cylinders by bias structure (31), the compressible pole (5) of this embodiment is composed of a first and second cylinders (32)(33) by bias structure (31), wherein the first cylinder (32) having a threading portion (34) formed for threadly secured the flag top (4) to dispose any decoration symbolizing a certain association as shown in FIGS. 3, 5. A bias structure (31), as shown in FIG. 4, is disposed at the lower end of said first cylinder (32) internally having a bias pole (35) and bias loops (36). A regular column (37) is secured to upper end of said bias pole (35) with an outer diameter being secured within the lower end of the first cylinder (32). A smaller bias column (40) is formed between two projections (38)(39) under said regular column (37), setting a protuberance (41) under said first projection (38) for looping said bias loop (36) having an open end and a recess (42) at top edge for free movement of the protuberance (41) in the first cylinder (32), corresponding thick wall (43) and thin wall (44) disposed therein for the insert of said second cylinder (33), secured by friction with the second cylinder (33) by the outwardly stretching force with the bias loop (36). By rotating the first cylinder (32) to correspond said bias column (40) with the thin wall (44) in the bias loop (36) the first cylinder (32) can easily draw and withdraw within the second cylinder (33), and by rotating the first cylinder (32) to correspond the protuberance (41) of said bias column (40) with the thick wall (43) in the bias loop (36), the first cylinder (32) is secured. At the bottom of said second cylinder (33) has a holder (45) for holding the flag pole (5) as shown in FIG. 1.

Figure 6:
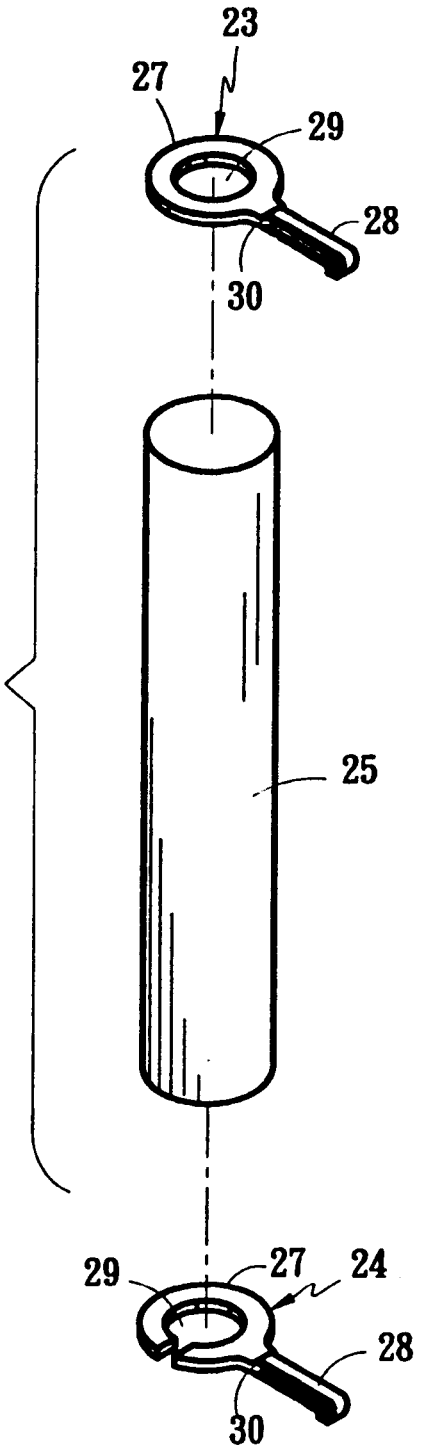
FIG. 6 is a decomposing view of another preferred embodiment.
Figure 7:
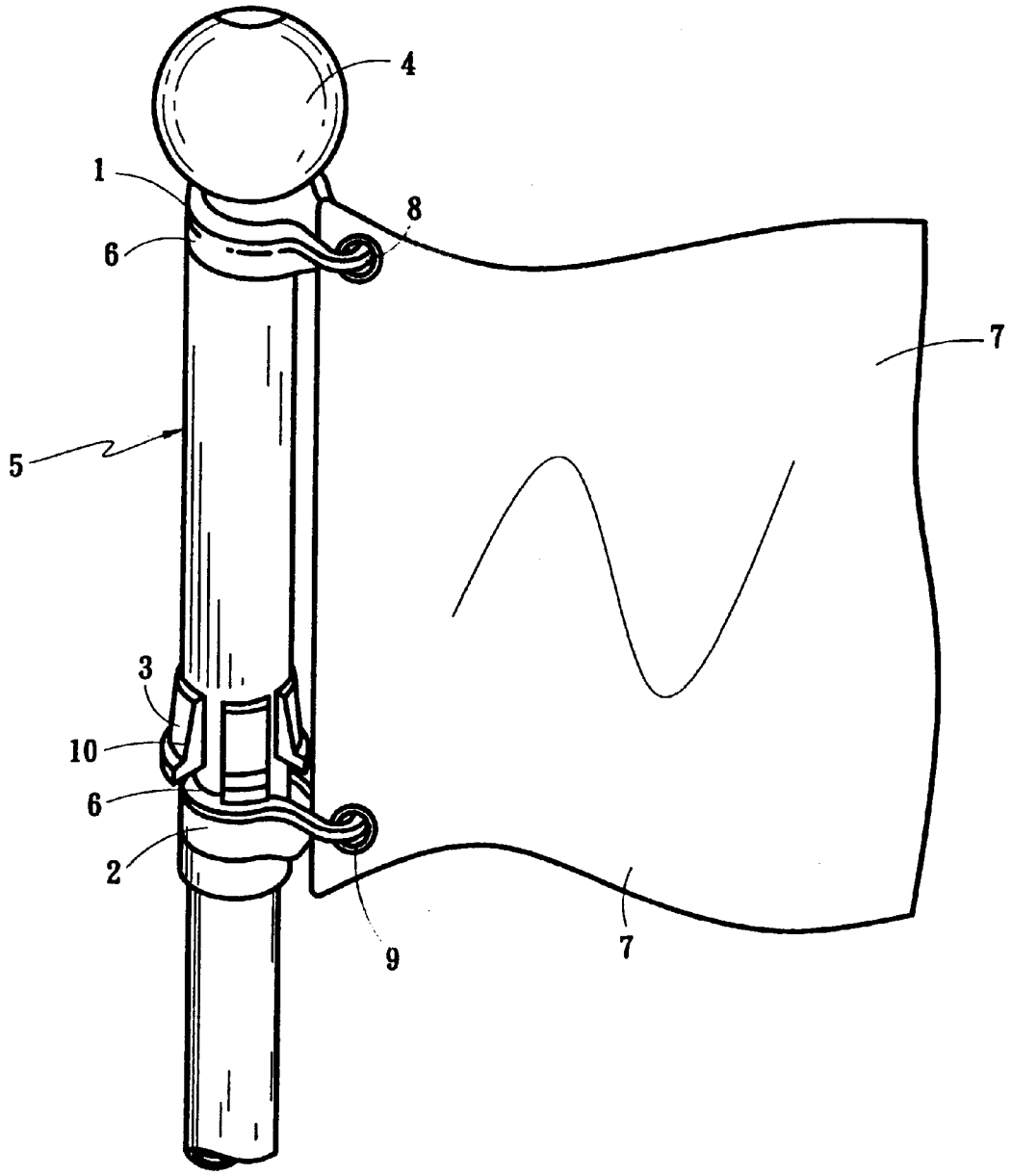
FIG. 7 PRIOR ART
FIG. 7 is a perspective view of the conventional structure in prior art.

Further referring to FIG. 6, showing one of,the preferred embodiments of banner connecting apparatus of this invention, therein, the upper coupling button (23) and cylinder (25) are of same structure with said embodiment, differing in the substitute of clamp (26) for the connecting ring (27) in the lower coupling button (24). A connecting hole (30) is provided at one edge of said clamp (26) for connecting the connecting button (28), clamping said clamp (26) on the bottom of said cylinder (25) at a corresponding position on the flag pole (5) to achieve same effect.

I claim:

1. A banner retention system for retaining a banner having at least a pair of coupling holes on a longitudinally extended flag pole comprising:

(a) upper and lower coupling buttons adapted to rotate about the flag pole, each of said upper and lower coupling buttons including:

(1) a connecting ring adapted to rotate about the flag pole, said connecting ring having an inner diameter greater than the outer diameter of the flag pole, said connecting ring having a radially projecting portion formed with a connecting hole passing therethrough; and, (2) a connecting button engaging said connecting hole of said connecting ring, said connecting button having a clip portion for releasably engaging a coupling hole of the banner;

(b) elastic retaining means for resiliently and frictionally engaging the flag pole, said elastic retaining means adjustably limiting the longitudinal displacement of at least one said connecting ring with respect to the flag pole; and, (c) a longitudinally extended cylindrical spacing sleeve of predetermined length adapted to be received on the flag pole and disposed between said upper and lower coupling buttons, said spacing sleeve longitudinally spacing said upper and lower coupling buttons, said cylindrical spacing sleeve being supported by said connecting ring of said lower coupling button.

2. The banner retention system as recited in claim 1 wherein said elastic retaining means supports said lower coupling button.

3. The banner retention system as recited in claim 2 wherein said elastic retaining means includes an elastic clamp in a discontinuous ring configuration for engaging the flag pole, said elastic clamp being disposed longitudinally beneath said lower coupling button.

4. The banner retention system as recited in claim 2 wherein said elastic retaining means includes an elastic segment formed on said connecting ring of said lower coupling button, said elastic segment having a discontinuous ring configuration for engaging the flag pole.

5. A banner retention system for retaining a banner having at least a pair of coupling holes comprising:

(a) a longitudinally extended flag pole having a plurality of telescopically coupled sections;

(b) upper and lower coupling buttons coupled to said flag pole, each of said upper and lower coupling buttons including:

(1) a connecting ring disposed about said flag pole, said connecting ring having an inner diameter greater than the outer diameter of said flag pole, said connecting ring having a radially projecting portion formed with a connecting hole passing therethrough; and, (2) a connecting button engaging said connecting hole of said connecting ring, said connecting button having a clip portion for releasably engaging a coupling hole of the banner;

(c) elastic retaining means for adjustably limiting the longitudinal displacement of at least one said connecting ring with respect to said flag pole; and, (d) a longitudinally extended cylindrical spacing sleeve of predetermined length received on said flag pole and disposed between said upper and lower coupling buttons, said spacing sleeve longitudinally spacing said upper and lower coupling buttons, said spacing sleeve being supported by said connecting ring of said lower coupling button.

6. The banner retention system as recited in claim 5 wherein at least a pair of said flag pole sections are coupled one to the other by bias coupling means, said bias coupling means including:

(a) a bias pole member having a regular column portion extending from a first radially projecting portion; a bias column portion extending between said first radially projecting portion and a second radially projecting portion; and, a protuberance portion protruding from said bias column portion; said regular column portion extending longitudinally into a first of said pair of flag pole sections; and, (b) a bias loop member releasably coupled to said bias pole member, said bias loop member having a first portion extending longitudinally into and frictionally engaging a second of said pair of flag pole sections and a second portion adapted to lockingly engage said protuberance.

7. The banner retention system as recited in claim 5 or 6 further comprising an ornamental top member releasably coupled to a terminal end of said flag pole.

* * * * *